US008628242B2

(12) United States Patent
Buller et al.

(10) Patent No.: US 8,628,242 B2
(45) Date of Patent: Jan. 14, 2014

(54) FOLDABLE BAG WITH RETAINING STRAPS

(75) Inventors: Josh Buller, New York, NY (US); Paul Scicluna, Penndel, PA (US)

(73) Assignee: Tumi, Inc., South Plainfield, NJ (US)

( * ) Notice: Subject to any disclaimer, the term of this patent is extended or adjusted under 35 U.S.C. 154(b) by 413 days.

(21) Appl. No.: 12/877,798

(22) Filed: Sep. 8, 2010

(65) Prior Publication Data

US 2012/0057809 A1 Mar. 8, 2012

(51) Int. Cl.
*B65D 30/00* (2006.01)

(52) U.S. Cl.
USPC ..... 383/2

(58) Field of Classification Search
USPC ..... 383/2, 4, 40
See application file for complete search history.

(56) References Cited

U.S. PATENT DOCUMENTS

| | | | | |
|---|---|---|---|---|
| 1,604,658 | A | 10/1926 | Post | |
| 1,672,322 | A | 6/1928 | Keiser et al. | |
| 1,719,455 | A * | 7/1929 | Steckler | 383/2 |
| 2,038,952 | A * | 4/1936 | Niedorff et al. | 224/218 |
| 3,142,324 | A * | 7/1964 | Fremont | 383/120 |
| 4,177,909 | A | 12/1979 | Haskell | |
| 5,316,388 | A * | 5/1994 | Caligiuri | 383/127 |
| 6,068,402 | A * | 5/2000 | Freese et al. | 383/110 |
| 6,092,702 | A | 7/2000 | Cassidy | |
| 6,296,094 | B1 | 10/2001 | Knecht | |
| 6,640,856 | B1 | 11/2003 | Tucker | |
| 7,958,920 | B1 * | 6/2011 | Olsson | 150/112 |
| 8,209,995 | B2 * | 7/2012 | Kieling et al. | 62/457.1 |
| 2007/0108241 | A1 | 5/2007 | Bass et al. | |
| 2008/0037907 | A1 | 2/2008 | Suskind | |
| 2009/0180715 | A1 | 7/2009 | Wittke-Kothe | |

OTHER PUBLICATIONS

International Search Report and Written Opinion for PCT/US2011/049845, dated Jan. 25, 2012.
Samsonite, "Folding bag (S)—How to fold".

* cited by examiner

*Primary Examiner* — Jes F Pascua
(74) *Attorney, Agent, or Firm* — Jon Fallon, Esq.

(57) ABSTRACT

A foldable bag comprising a compartment for holding articles including first and second opposing body panels constructed of a foldable material and connected to each other along a pair of sides and a bottom bridging the pair of sides to define an open mouth formed opposite the bottom. The sides and the bottom of the compartment are foldable to collapse the compartment, and the compartment is maintained in the collapsed configuration in a variety of ways. In one embodiment, fastening straps can be provided proximate the mouth and extend outward beyond the sides to releasably engage fastening members on the first panel proximate the bottom. Alternatively, a reclosable flap member can be coupled to a panel and include a strap defining a retention loop, wherein the compartment is maintained in the collapsed configuration when the sides are disposed within the retention loop. Alternatively, a strap can be coupled to the compartment proximate the bottom to define a retention loop, and a carrying handle can be coupled proximate to the mouth wherein the compartment is maintained in the collapsed configuration when the carrying handle is advanced through the retention loop.

3 Claims, 5 Drawing Sheets

350B
350A
319
314
318
319

350B
334
319
350A
321
314
330
332
319

318
334
312
350A
330
314
350B
320
332
300
316
322
313

334
350B
319
350A
321
314
320
318
332
319

FOLDABLE BAG WITH RETAINING STRAPS

BACKGROUND OF THE DISCLOSED SUBJECT MATTER

1. Field of the Disclosed Subject Matter

The disclosed subject matter relates to collapsible bags. Particularly, the present disclosed subject matter is directed to a collapsible bag that is retainable in its collapsed position, while permitting access to the contents of the bag.

2. Description of Related Art

A variety of structures and methods are known for collapsible bags in which items or articles can be carried or transported. This collapsible feature is especially useful when an individual is travelling and may need more or different types of bags at the individual's travel destination or may need additional bags either during the trip to or the trip back from the destination, but not for the entire round trip.

The actual transport or storage of a collapsible bag by the individual, however, is often somewhat of an inconvenience. For example, collapsible bags are not typically designed to be maintained in their collapsed state. Thus, there is a tendency for the bags to unfold, especially when the luggage in which they are stored are subjected to the harsh treatment often endured by luggage during travel. Accordingly, some prior art designs include a closure means to maintain the bag in a collapsed configuration, an example of which is disclosed in U.S. Pat. No. 6,640,856, the entirety of which is hereby incorporated by reference.

However, with conventional collapsible bags, when the bags are folded into the collapsed configuration, the bags are configured for storage only, i.e., the contents of the bags are removed prior to folding. Furthermore, the interior of the bag is not accessible when in the collapsed configuration.

There thus remains a need for an efficient and economic method and system for a collapsible bag with a variety of closure mechanisms that maintain the bag in the collapsed configuration while permitting access to the contents and interior of the bag.

SUMMARY OF THE DISCLOSED SUBJECT MATTER

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a bag, and corresponding method of converting or collapsing a bag from a first expanded position to a second collapsed configuration. The foldable bag comprises a compartment for holding articles including first and second opposing body panels constructed of a foldable material and connected to each other along a pair of sides and a bottom bridging the pair of sides to define an open mouth formed opposite the bottom. In one embodiment, at least one strap is coupled to the first panel, the at least one strap disposed proximate the mouth and including a first fastening member. Additionally, a second fastening member is disposed on the first panel proximate the bottom, with the first and second fastening members configured to be releasably attached. The sides and the bottom of the compartment are foldable to collapse the compartment with the at least one strap extending outward beyond a boundary of the compartment when in a collapsed configuration, wherein the compartment is maintained substantially in the collapsed configuration when the first fastener is attached to the second fastener.

In this embodiment, a first strap extends outward beyond a first boundary of the compartment when in a collapsed configuration, and a second strap extends outward beyond a second boundary of the compartment when in a collapsed configuration. Further, the first and second fastening members are snap fasteners, and the bag includes a carrying handle attached to the compartment proximate to the mouth for carrying the bag. In accordance with an aspect of the disclosed subject matter, the mouth remains substantially open when the compartment is in the collapsed configuration, and the first and second panels include a closure device, e.g., a zipper arrangement, disposed proximate the mouth for closing the opening of the compartment.

A first side of the first panel is stitched to a first side of the second panel, and a second side of the first panel is stitched to a second side of the second panel. Alternatively, the compartment comprises a single piece of fabric for the first and second panels with a fold defining the bottom. Additionally, the first panel can include an external pouch disposed proximate the mouth, the at least one strap disposed laterally adjacent the pouch.

In another embodiment, the foldable bag comprises a compartment for holding articles including first and second opposing body panels constructed of a foldable material and connected to each other along a pair of sides and a bottom bridging the pair of sides to define an open mouth formed opposite the bottom. A reclosable flap member is coupled to a panel, and includes a strap having a first end and a second end, with the first and second ends coupled to the reclosable flap member to define a retention loop. The sides and the bottom of the compartment are foldable to collapse the compartment with the compartment maintained substantially in the collapsed configuration when the sides are disposed within the retention loop.

In use, the mouth remains substantially open when the compartment is in the collapsed configuration. Additionally, the first and second panels include a closure device, e.g., a zipper arrangement, disposed proximate the mouth for closing the opening of the compartment. The reclosable flap member is disposed on the first panel proximate the mouth and includes at least one fastening member to engage a fastening member disposed on the first panel.

In another embodiment, the foldable bag comprises a compartment for holding articles. The foldable bag includes first and second opposing body panels constructed of a foldable material and connected to each other along a pair of sides and a bottom bridging the pair of sides to define an open mouth formed opposite the bottom. Additionally, a strap is provided having a first end and a second end, with the first and second ends coupled to the compartment proximate the bottom to define a retention loop. At least one carrying handle is coupled to the compartment proximate to the mouth for carrying the bag wherein the sides and the bottom of the compartment are foldable to collapse the compartment with the compartment maintained substantially in the collapsed configuration when the at least one carrying handle is advanced through the retention loop.

In use, the mouth remains substantially open when the compartment is in the collapsed configuration. Additionally, the first and second panels include a closure device, e.g., a zipper arrangement, disposed proximate the mouth for closing the opening of the compartment. Additionally, the strap is disposed on the bottom of the compartment.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

DETAILED DESCRIPTION OF AN EXEMPLARY EMBODIMENT

Figure 3:
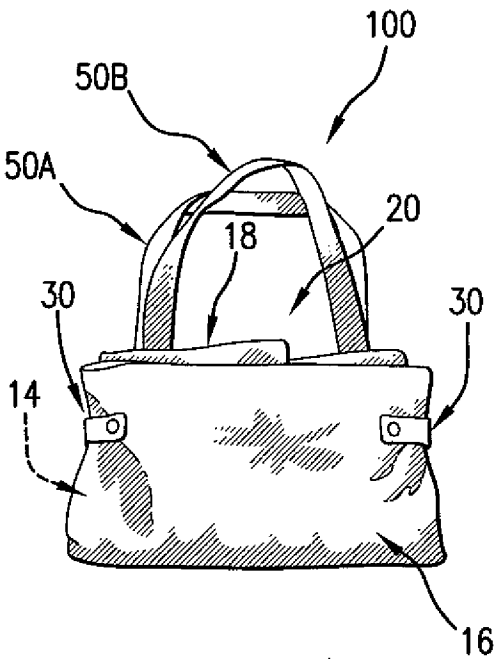
FIG. 3 is a schematic representation of a rear view of the foldable bag of FIG. 1, shown in the collapsed configuration, in accordance with the disclosed subject matter.

Reference will now be made in detail to an exemplary embodiment of the disclosed subject matter, examples of which are illustrated in the accompanying drawings. The bag structures and corresponding steps of the disclosed subject matter will be described in conjunction with the detailed description of the system.

The methods and systems presented herein may be used for folding a bag into a collapsed configuration. The disclosed subject matter is particularly suited for permitting access to the contents of the bag while the bag is maintained in the collapsed configuration. For purpose of explanation and illustration, and not limitation, an exemplary embodiment of the system in accordance with the disclosed subject matter is shown in FIGS. 1-4D and is designated generally by reference character 100.

Figure 1:
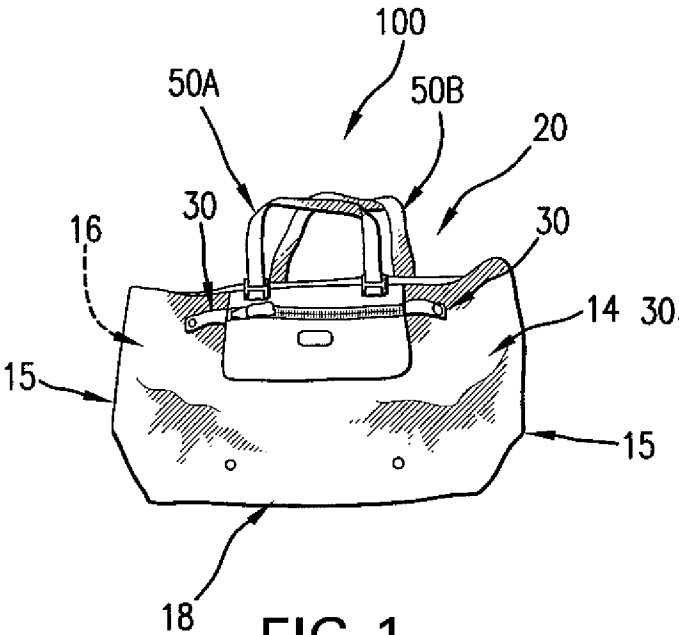
FIG. 1 is a schematic representation of a front view of an exemplary embodiment of a foldable bag with retaining straps, shown in the expanded configuration, in accordance with the disclosed subject matter.

As shown in FIG. 1, the system generally includes a collapsible bag 100 that has a compartment 12 for holding articles (not shown). In a certain embodiment, although not necessary, the compartment 12 is constructed substantially of a single piece of material. Alternatively, the compartment 12 can be constructed of a plurality of discrete pieces of material which are coupled together, e.g., by stitching, adhesive, welding, etc.

The compartment 12 has a first panel 14 and an opposing second panel 16 connected to each other along a pair of sides 15, a bottom 18 bridging the pair of sides, and a mouth 20 formed opposite the bottom. The mouth can be opened or otherwise unobstructed, e.g., at discrete location(s) between the two sides, or across the entire length of the mouth, to provide access to the contents of the compartment. Additionally, and although not necessary, the mouth 20 can be sealable. In a certain embodiment, the sealing arrangement for the compartment 12 is a zipper 22. Other sealing arrangements may include but are not limited to magnets, snap fasteners, hook and loop fasteners, etc.

Figure 2:
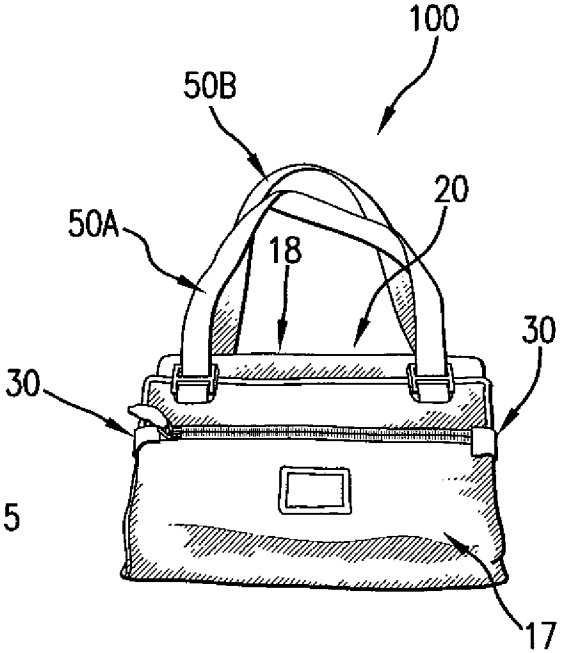
FIG. 2 is a schematic representation of a front view of the foldable bag of FIG. 1, shown in the collapsed configuration, in accordance with the disclosed subject matter.
Figures 4A, 4B, 4C, 4D:
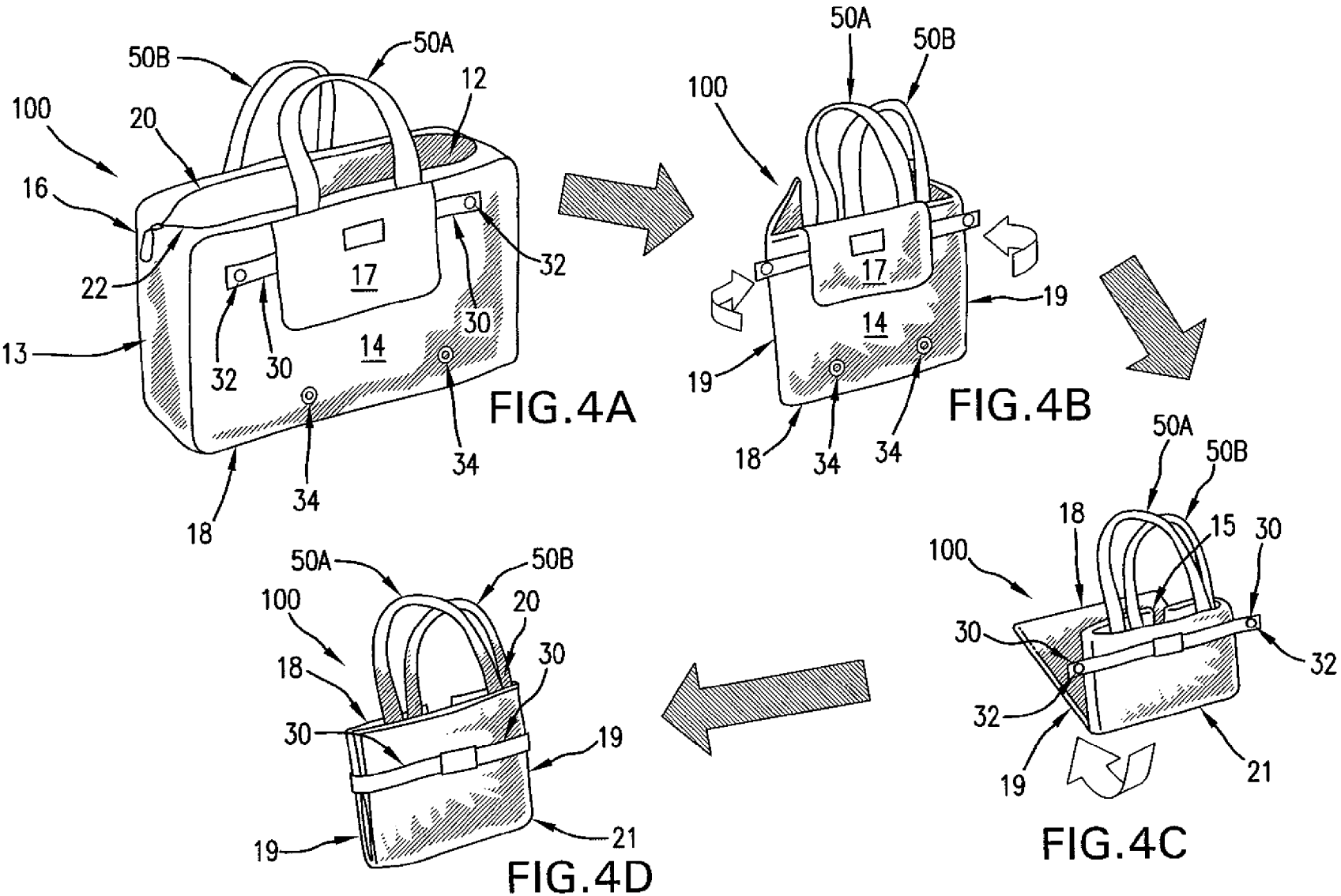
FIGS. 4A-D are schematic representations of various folding stages of the foldable bag of FIG. 1, in accordance with the disclosed subject matter.

The sides 15 of the first 14 and second 16 panels can be directly connected to each other, as depicted in FIGS. 1-3. Alternatively, an additional side panel, e.g., a gusset, can be disposed between the two panels such that the first 14 and second 16 panels are connected to each other through the side panel 13, as depicted in FIG. 4A. The compartment 12 is constructed of a foldable, resilient material such as leather, textiles, or nylon fabrics, although various materials can be used for an array of looks and seasonal selections. Optionally, an external patch 17 can be coupled to at least one of the panels 14, 16 and include indicia, such as a logo or trademark, so that the manufacturer or distributor can be prominently displayed on the bag. Additionally, the external patch 17 can be configured as an external pouch or pocket, with a separate closure means from the mouth 20, which can increase the storage capacity of the bag and provide easy access to the contents disposed therein.

As illustrated in FIGS. 1-4D, a pair of straps 30 are coupled to the first panel 14 at a location proximate the mouth 20 of the compartment. The straps 30 can be of a fixed length and extend in a generally lateral direction from the patch 17. Alternatively, the straps 30 can be extendable, e.g., made of elastomeric material, such that the straps can be advanced to extend beyond the sides of the compartment 12, as will be discussed in further detail below, and retracted into a housing on or between the patch 17 and panel 14.

Figure 7:
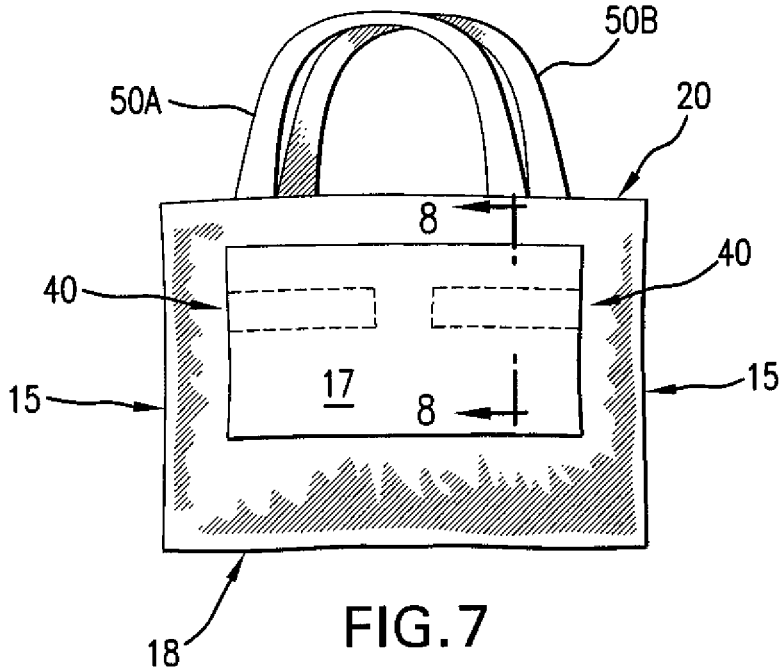
FIG. 7 is a schematic representation of a retractable strap housed within a portion of the bag in accordance with the disclosed subject matter.
Figure 8:
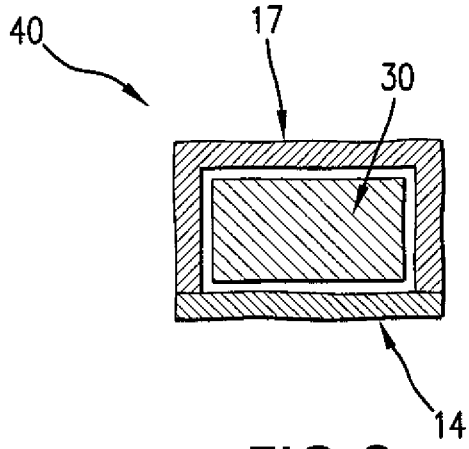
FIG. 8 is a cross-sectional view of the retractable strap and housing of FIG. 7.

An exemplary embodiment of such a housing 40 is illustrated in FIGS. 7-8, wherein the straps can be retracted into the housing 40 when the bag is in the expanded configuration, i.e., when the straps 30 are not engaged to retain the bag in the folded configuration. The housing 40 can be arranged to receive or extend over the entirety of the strap 30, or alternatively a portion of the strap 30 can remain exposed beyond the housing to allow a user to easily grasp and retrieve the strap 30 from its retracted position. This retractable feature of the straps 30 can be advantageous in that the straps 30 are able to retract into the housing when the bag is in the expanded configuration, and therefore are not prone to damage, undesired dangling or interference with the user.

A first set of fastening members 32 is provided on the straps 30, proximate the end thereof. Similarly, a second set of fastening members 34 are provided on the panel 14 and disposed proximate the bottom. The first set of fastening members 32 are positioned and arranged to engage the second set of fastening members 34, when the bag is in the collapsed configuration. As such, the first set of fastening members can be configured as female members and the second set of fastening members 34 can be configured as male members. Additionally, a third set of fastening members (not shown) can be provided on the panel 14 at a position that coincides with the first set of fastening members 32, when the bag is in the expanded configuration of FIG. 1. This third set of fastening members allows for the straps 30 to be securely fastened and retained in position during use of the bag in the expanded configuration, thereby preventing damage or undesired interference of the strap with the user. Although the fastening members illustrated are snap fasteners, alternative or additional fastening members can be employed if so desired, e.g., hook and loop fasteners, magnets, etc.

In accordance with the disclosed subject matter, the bag 100 can be converted from an expanded configuration, which maximizes the cargo capacity of the bag, to a collapsed configuration, which reduces the bag profile while permitting access to the contents of the bag through the open (i.e., partially or entirely as described above) mouth, if so desired. In the exemplary embodiment illustrated in FIGS. 1-4D, the user can first detach the first set of fasteners 32 from the third set of fasteners (not shown) if so provided. The user can fold the sides 15 (as well as the gusset or side panels 13, if present) of the bag backwards to overlie panel 16, which forms a boundary edge of the bag, e.g., creases 19 as shown in FIG. 4B. Thereafter, the user can fold the bottom 18 upwards to overlie panel 16 and form a lower boundary edge of the bag, e.g., crease 21 as shown in FIG. 4C. This folding motion re-orients or re-positions the second set of fastening members 34 to be disposed on an opposing face of the bag 100 from the first set of fastening members 32. The straps are then wrapped around the boundary edges, i.e. creases 19, and are positioned such that the first set of fastening members 32 are aligned with the second set of fastening members 34 for releasable attachment thereto.

Engagement of the fastening members 32, 34 securely maintains the bag in the collapsed configuration, as depicted in FIG. 4D. In accordance with an aspect of the disclosed subject matter, the mouth 20 remains open (i.e., partially or entirely as described above) and permits access to the interior of the compartment 12 in this configuration, albeit the reduced capacity of the compartment as defined by the boundary edges, i.e. creases 19, 21. This is advantageous as it increases the functionality of the bag by allowing the user to store items, e.g., cell phone, car keys, etc. within the reduced capacity compartment. In other words, the collapsible feature of the bag allows for a reduction in size of the bag which facilitates storage, as discussed above, and further serves as a scalable bag which can be expanded or collapsed as needed to accommodate varying amounts of cargo.

Figures 5A, 5B, 5C, 5D, 5E:
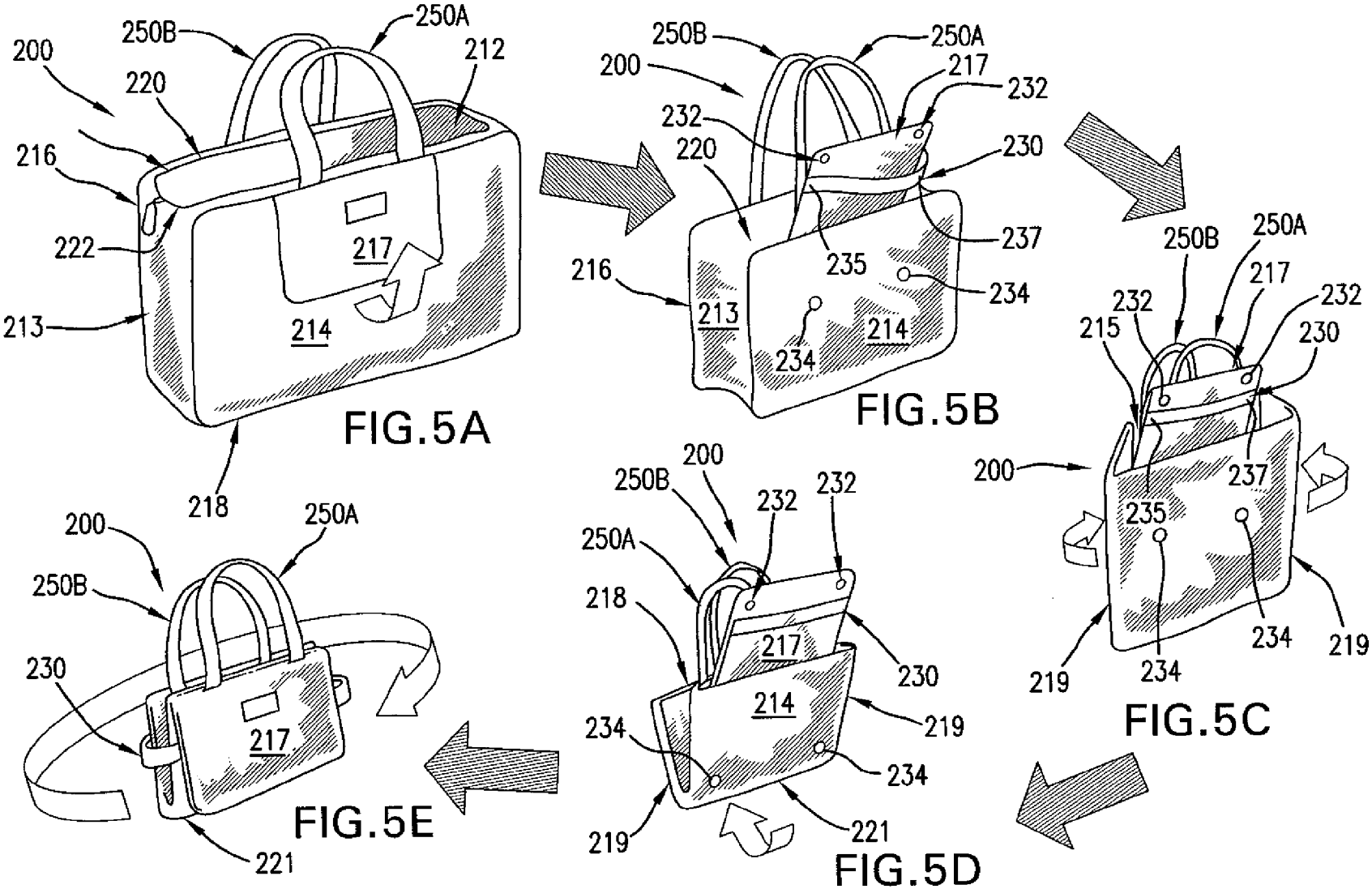
FIGS. 5A-E are schematic representations of various folding stages of another exemplary embodiment of a foldable bag in accordance with the disclosed subject matter.

In accordance with another aspect of the disclosed subject matter, an alternative exemplary embodiment of the foldable bag is provided in FIGS. 5A-E. As shown in FIG. 5A, the system generally includes a collapsible bag 200 that has a compartment 212 for holding articles (not shown). As discussed above with reference to the embodiment of FIGS. 1-4E, the compartment 212 can be constructed substantially of a single piece of material, or a plurality of discrete pieces of material which are coupled together, e.g., by stitching, adhesive, welding, etc.

The compartment 212 has a first panel 214 and an opposing second panel 216 connected to each other along a pair of sides 215, a bottom 218 bridging the pair of sides, and a mouth 220 formed opposite the bottom. Although not necessary, the opening 220 may be sealable. In a certain embodiment, the sealing arrangement for the compartment 212 is a zipper 222. Other sealing arrangements may include but are not limited to magnets, snap fasteners, hook and loop fasteners, etc.

The sides 215 of the first 214 and second 216 panels can be directly connected to each other. Alternatively, an additional side panel, e.g., a gusset, can be disposed between the two panels such that the first 214 and second 216 panels are connected to each other through the side panel 13, as depicted in FIG. 5A. The compartment 212 is constructed of a foldable, resilient material such as leather, textiles, or nylon fabrics, although various materials can be used for a variety of looks and seasonal selections.

In accordance with another aspect of the disclosed subject matter, a reclosable flap 217 is coupled to one of the panels 214, 216 and includes indicia, such as a logo or trademark, so that the manufacturer or distributor can be prominently displayed on the bag. Additionally, the reclosable flap 217 can be configured as an external pouch or pocket, with a separate closure means from the mouth 220, which can increase the storage capacity of the bag and provide easy access to the contents disposed therein.

As illustrated in FIGS. 5B-E, the reclosable flap 217 is disposed at a location proximate the mouth 220 of the compartment 212. A strap 230 is coupled to the reclosable flap 217 on an underside of the reclosable flap 217, i.e., the surface adjacent the panel 214. The strap has first and second ends 235, 237 which are coupled to the reclosable flap 217 to form a retention loop. The strap 230 can be made of a relatively rigid, inelastic material such as leather. Alternatively, the strap 230 can be extendable, e.g., made of elastomeric material.

A first set of fastening members 232 is provided on the underside of the reclosable flap 217, proximate the bottom thereof. Similarly, a second set of fastening members 234 are provided on the panel 214 and disposed proximate the middle of the panel. The first set of fastening members 232 are positioned and arranged to engage the second set of fastening members 234, when the bag is both in the expanded and collapsed configurations. As such, the first set of fastening members can be configured as female members and the second set of fastening members can be configured as male members. Although the fastening members illustrated are snap fasteners, alternative or additional fastening members can be employed if so desired, e.g., hook and loop fasteners, magnets, etc.

In accordance with the disclosed subject matter, the bag 200 can be converted from an expanded configuration, which maximizes the cargo capacity of the bag, to a collapsed configuration, which reduces the bag profile while permitting access to the contents of the bag through the mouth, if so desired. In the exemplary embodiment illustrated in FIGS. 5A-E, the user can first detach the first set of fasteners 232 from the second set of fasteners 234 so that the reclosable flap can be opened, or pivoted upwardly, to expose the strap 230, as shown in FIG. 5B. The user can fold the sides 215 (as well as the gusset or side panels 213, if present) of the bag backwards to overlie panel 216, which forms a boundary edge of the bag, e.g., creases 219, as shown in FIG. 5C. Thereafter, the user can fold the bottom 218 upwards to overlie panel 216 and form a lower boundary edge of the bag, e.g., crease 221, as shown in FIG. 5D. The strap 230 is then looped or wrapped around the reduced profile compartment such that the panels 214, 216, sides 215, and boundary edges, i.e., creases 219, are retained within the retention loop formed by the perimeter of the strap, as shown in FIG. 5E. The reclosable flap 217 is pivoted downward during this step in order to reestablish engagement of fastening members 232, 234.

Engagement of the fastening members 232, 234 securely maintains the bag in the collapsed configuration, as depicted in FIG. 5E. That is, the strap 230 is prevented from displacement downward in which the retention loop of the strap 230 might accidentally fall down or be disengaged from the compartment 212. As discussed above, the mouth 220 remains open (i.e., partially or entirely as described above) and permits access to the interior of the compartment 212 in this configuration, thereby affording the same advantages with respect to the exemplary embodiment illustrated in FIGS. 1-4D.

Figures 6A, 6B, 6C, 6D:
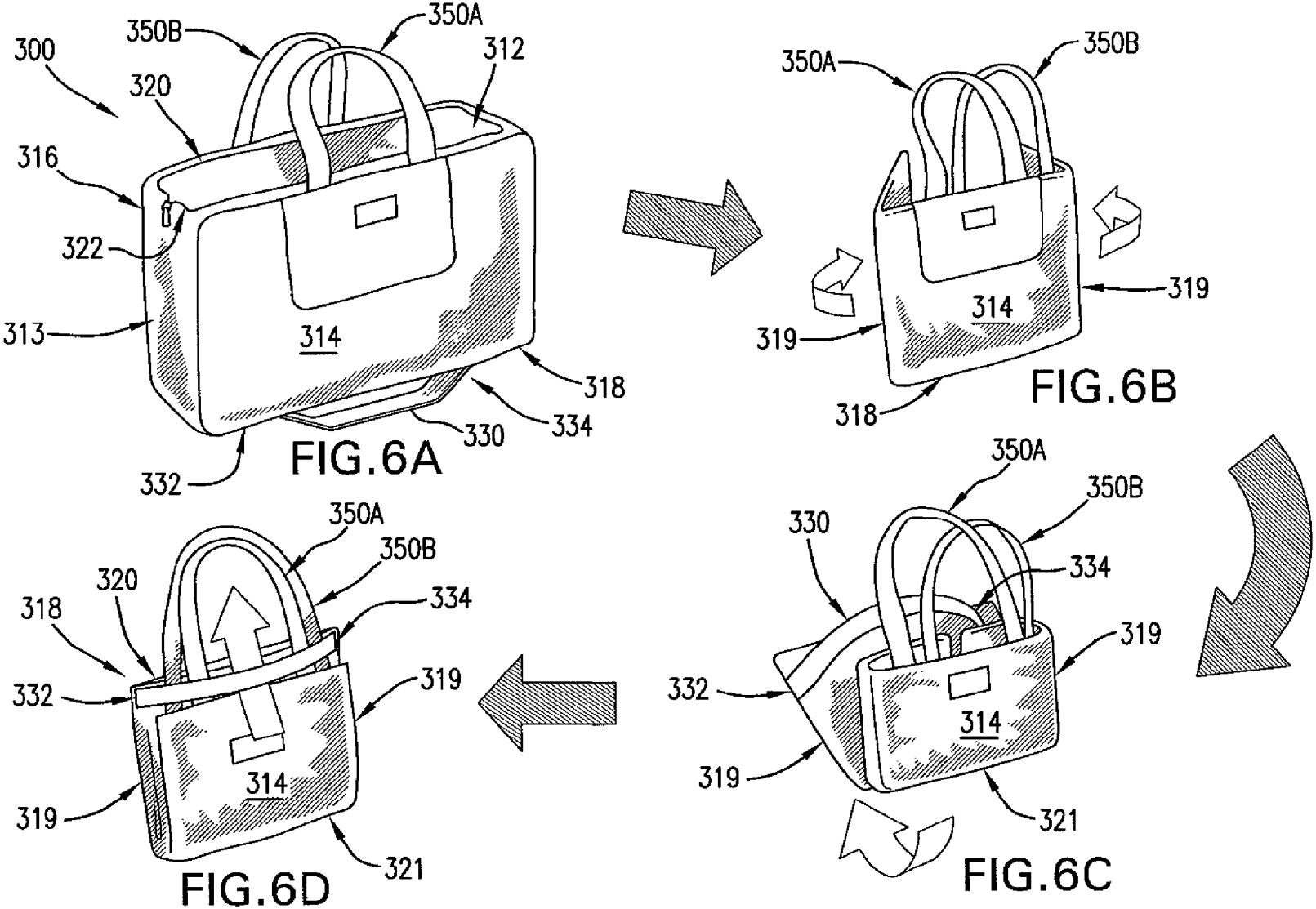
FIGS. 6A-D are schematic representations of various folding stages of yet another exemplary embodiment of a foldable bag in accordance with the disclosed subject matter.

In accordance with another aspect of the disclosed subject matter, an alternative exemplary embodiment of the foldable bag is provided in FIGS. 6A-E. As shown in FIG. 6A, the system generally includes a collapsible bag 300 that has a compartment 312 for holding articles (not shown) and two handles 350*a*, 350*b*. As discussed above with reference to the embodiment of FIGS. 1-4E, the compartment 312 can be constructed substantially of a single piece of material, or a plurality of discrete pieces of material which are coupled together, e.g., by stitching, adhesive, welding, etc.

The compartment 312 has a first panel 314 and an opposing second panel 316 connected to each other along a pair of sides 315, a bottom 318 bridging the pair of sides, and an mouth 320 formed opposite the bottom. Although not necessary, the opening 320 may be sealable. In a certain embodiment, the sealing arrangement for the compartment 312 is a zipper 322. Other sealing arrangements may include but are not limited to magnets, snap fasteners, hook and loop fasteners, etc.

The sides 315 of the first 314 and second 316 panels can be directly connected to each other. Alternatively, an additional side panel, e.g., a gusset, can be disposed between the two panels such that the first 314 and second 316 panels are connected to each other through the side panel 313, as depicted in FIG. 6A. The compartment 312 is constructed of a foldable, strong material such as leather, textiles, or nylon fabrics, although various materials can be used for a variety of looks and seasonal selections.

As illustrated in FIGS. 6A-D, a strap 330 is coupled to the compartment proximate the bottom 318 at ends 332, 334 to form a retention loop. The strap 330 can be of a fixed length, or alternatively, the strap 330 can be extendable, e.g., made of elastomeric material, such that the strap can be advanced to extend a greater distance from the bottom 318, and retracted into the compartment. This can be advantageous in that the strap 330 is able to retract into one or more housings, as discussed above with regards to FIGS. 7-8, when the bag is in the expanded configuration, and therefore is not prone to damage, undesired dangling or interference with the user.

In accordance with the disclosed subject matter, the bag can be converted from an expanded configuration, which maximizes the cargo capacity of the bag, to a collapsed configuration, which reduces the bag profile while permitting access to the contents of the bag through the mouth, if so desired. In the exemplary embodiment illustrated in FIGS. 6A-D, the user can fold the sides 315 of the bag (as well as the gusset or side panels 313, if present) backwards to overlie panel 316, which forms a boundary edge of the bag, e.g., creases 319 as shown in FIG. 6B. Thereafter, the user can fold the bottom 318 upwards to overlie panel 316 and form a lower boundary edge of the bag, e.g., crease 321 as shown in FIG. 6C. The handle 350A and/or 350B, as described in further detail below, is then passed through the retention loop of the strap 330.

The positioning of the handle 350A within the retention loop securely maintains the bag in the collapsed configuration, as depicted in FIG. 6D. That is, since the handle 350A is fixedly coupled to the panel, the restriction of movement provided by the strap 330 on the handle 350A is imparted onto the panel. Accordingly, the bag is retained in the collapsed configuration until the user deliberately removes the handle 350A from the retention loop formed by the strap 330. As discussed above, the mouth 320 remains open (i.e., partially or entirely as described above) and permits access to the interior of the compartment 312 in this configuration, thereby affording the same advantages with respect to the exemplary embodiment illustrated in FIGS. 1-4D. Alternatively, the handle 350B can be used instead of, or in addition to, handle 350A in the same manner as described herein for the handle 350A.

In each of the exemplary embodiments disclosed herein, one or more carrying handles 50 are attached to the compartment 12 proximate to the opening 20 at the top for carrying the bag 100. The lengths of the handles can also vary as desired. For example, a longer handle length would be used when the bag is used as a shoulder bag as opposed to a hand bag. Also, the size of the compartment may affect the length of the handle. Similarly the width and thickness of the handle may vary as desired.

The methods and structures presented herein may be used for bags of various sizes and shapes, such as backpacks, briefcases, suitcases, tote bags, pocket books, etc. Additionally, the various components disclosed herein, e.g. panels, patches, straps, handles, etc. can be coupled by stitching, adhesives, welding, or any other suitable means known in the art.

While the disclosed subject matter is described herein in terms of certain exemplary embodiments, those skilled in the art will recognize that various modifications and improvements may be made to the disclosed subject matter without departing from the scope thereof. Moreover, although individual features of one embodiment of the disclosed subject matter may be discussed herein or shown in the drawings of the one embodiment and not in other embodiments, it should be apparent that individual features of one embodiment may be combined with one or more features of another embodiment or features from a plurality of embodiments.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter includes modifications and variations that are within the scope of the appended claims and their equivalents.

The invention claimed is:

1. A foldable bag comprising:

a compartment for holding articles including first and second opposing body panels constructed of a foldable material and connected to each other along a pair of sides and a bottom bridging the pair of sides to define a mouth formed opposite the bottom;

a recloseable flap member coupled to a panel, the recloseable flap member disposed on the first panel proximate the mouth and having at least one fastening member to engage a fastening member disposed on the first panel;

a strap having a first end and a second end, the first and second ends coupled to the recloseable flap member to define a retention loop;

wherein the sides and the bottom of the compartment are foldable to collapse the compartment with the compartment maintained substantially in the collapsed configuration when the sides are disposed within the retention loop.

2. The foldable bag of claim 1, wherein the mouth remains at least partially open when the compartment is in the collapsed configuration.

3. The foldable bag of claim 1, wherein the first and second panels include a closure device disposed proximate the mouth for closing an opening of the compartment.

* * * * *